US010736448B2

(12) United States Patent
Clark et al.

(10) Patent No.: US 10,736,448 B2
(45) Date of Patent: Aug. 11, 2020

(54) EATING UTENSIL SUPPORT ASSEMBLY

(71) Applicants: Cole K. Clark, Woodway, TX (US); Travis J. Clark, Woodway, TX (US)

(72) Inventors: Cole K. Clark, Woodway, TX (US); Travis J. Clark, Woodway, TX (US)

( * ) Notice: Subject to any disclaimer, the term of this patent is extended or adjusted under 35 U.S.C. 154(b) by 0 days.

(21) Appl. No.: 16/240,741

(22) Filed: Jan. 5, 2019

(65) Prior Publication Data

US 2020/0214483 A1 Jul. 9, 2020

(51) Int. Cl.
*A47G 21/14* (2006.01)

(52) U.S. Cl.
CPC ..... *A47G 21/14* (2013.01)

(58) Field of Classification Search
CPC ..... A47G 21/14
See application file for complete search history.

(56) References Cited

U.S. PATENT DOCUMENTS

D26,319 S 11/1896 Wood
2,249,851 A * 7/1941 Pilliod ..... A47F 7/03 206/745
2,557,398 A * 6/1951 Teetor ..... G09F 1/14 40/124.04
2,651,927 A * 9/1953 Mullins ..... A47G 21/14 220/890
3,746,296 A * 7/1973 Dean ..... A47B 65/00 248/441.1
D244,340 S 5/1977 Ashton
D292,861 S 11/1987 Dorper
4,834,328 A 5/1989 Hall
5,332,106 A * 7/1994 Schlotte ..... A47G 21/14 211/49.1
5,411,141 A 5/1995 Bounds
6,116,418 A * 9/2000 Sadow ..... G06F 1/1628 190/110
7,266,865 B1 9/2007 Rodin
D689,743 S * 9/2013 Tarantino ..... G09F 1/14 D7/637
8,668,171 B2 * 3/2014 Tarantino ..... A47G 21/14 220/500
2009/0261049 A1 * 10/2009 McQuary ..... A47F 7/0028 211/70.7
2011/0114533 A1 5/2011 Le
2011/0180681 A1 * 7/2011 Guirlinger ..... B43K 23/002 248/346.03
2012/0298807 A1 11/2012 Rayko
2015/0157154 A1 6/2015 Rothenberg

* cited by examiner

*Primary Examiner* — Anita M King
(74) *Attorney, Agent, or Firm* — John A. Powell; Naman, Howell, Smith & Lee, PLLC

(57) ABSTRACT

An eating utensil support assembly with multiple tabletop utensil supports that may be used to support eating utensils such as forks, knives, and spoons or other utensils when they are placed on tabletops or countertops so that the eating utensils are elevated using the utensil supports and are not contaminated by materials on the tabletops or countertops.

21 Claims, 6 Drawing Sheets

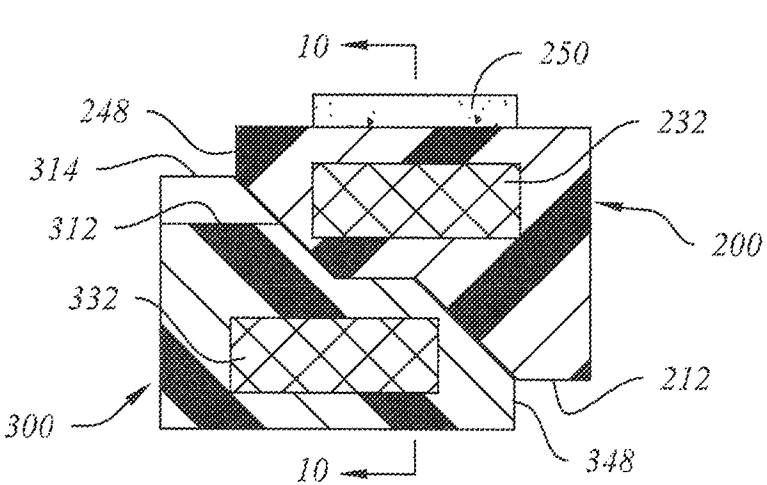
FIG. 7
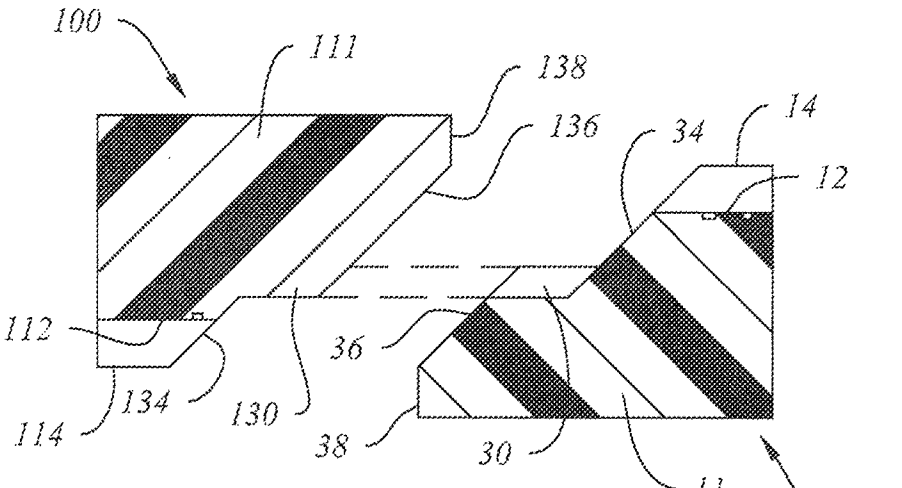
FIG. 6
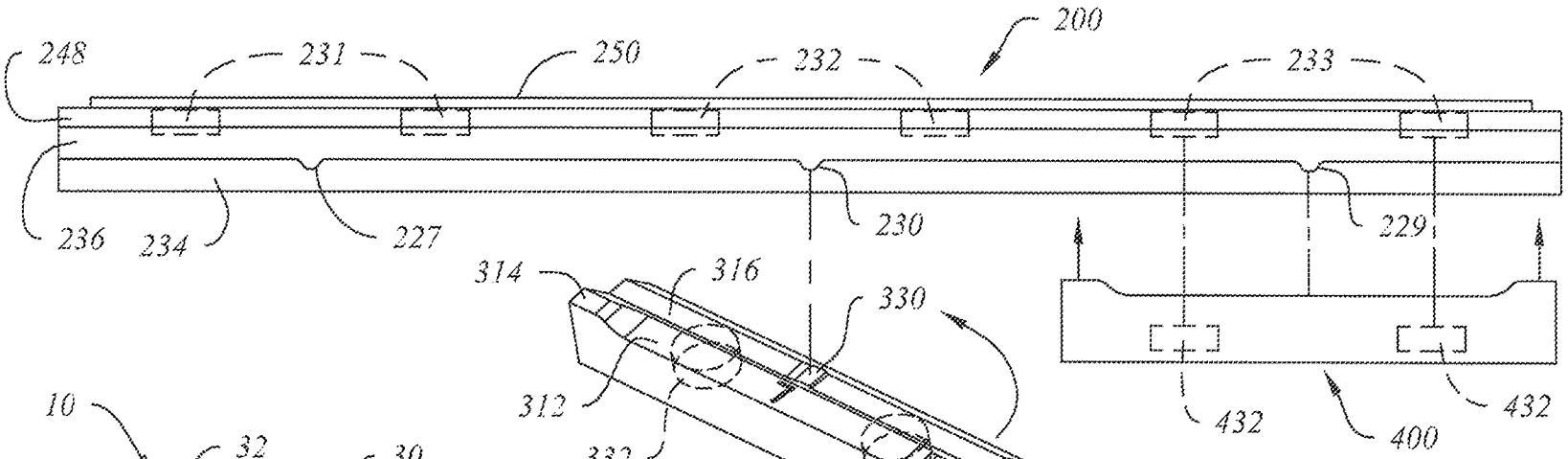
FIG. 8
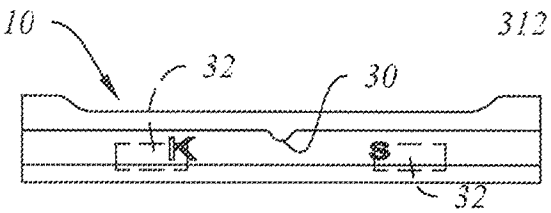

EATING UTENSIL SUPPORT ASSEMBLY

BACKGROUND AND FIELD OF THE INVENTION

The present invention relates to tabletop and countertop supports for eating utensils, and more particularly to eating utensil supports that can be used to elevate eating utensils such as forks, knives, and spoons above the surfaces of tabletops or countertops in an eating or dining setting.

Eating utensils such as forks, knives, a spoons are essential tools that are used in daily life both in the privacy of homes and in public restaurants. Although there are numerous methods for cleaning or sanitizing eating utensils, it is common during meals in both public and private settings for previously cleaned or sanitized eating utensils to be placed directly on tabletops or countertops that have not been properly cleaned beforehand. As a result, the eating utensils can become contaminated prior to an during use because they come into contact with surfaces that are not clean and that may contain bacteria, viruses, or other undesirable foreign substances. Such an unhygienic situation can foster the spread of illness and disease and is generally unpalatable. Many people attempt to prevent their eating utensils from being contaminated by the unclean surfaces of tables and counters by placing their utensils on a paper napkin or other paper item, but this generates additional waste and often results in the paper napkin or other paper item sticking to the bottom of the utensils. Further, use of cloth napkins or tablecloths to prevent contamination frequently results in a mess being created such that the cloth napkins or tablecloths are soiled and stained during the eating process. As can be understood, there is a constant concern with eating hygiene in the public and private settings that requires a clean and efficient way to keep eating utensils separate from the tabletops and countertops on which they are placed during eating;

In addition, while there are various prior art designs, and devices that have been proposed for supporting eating utensils and kitchenware/silverware, no practical method or device for the simple, efficient storage and transport of such support devices has been demonstrated.

SUMMARY OF THE INVENTION

It is an object of the invention to provide tabletop utensil supports that allow for the uniform, organized, and sanitary placement of eating utensils on top of the surfaces of tabletops and countertops in both residential and restaurant settings during meals and dining.

It is a further object of the invention to provide a means for the simple and efficient storage and transport of the tabletop utensil supports that are hereby disclosed.

The invention hereby disclosed is best understood as an assembly of multiple tabletop utensil supports, including at least two separate utensil supports that may be used to support eating utensils such as forks, knives, and spoons when they are placed on tabletops or countertops so that eating utensils elevated using the utensil supports are not contaminated by anything that may be present on the surfaces below. The invention also provides means for storage and transport of the utensil supports both in the private and public settings.

In one embodiment of the invention hereby disclosed, there are two utensil supports that form a detachable assembly during transport or storage, but that may be detached from one another and placed separately on top of a tabletop or countertop in order to be used to elevate eating utensils above the surfaces of the table or counter so that there is sufficient clearance of the utensils from such surfaces that will prevent contamination of the utensils during meals. Each of the two utensil supports has an elongate body with several edges and planar surfaces, including a utensil rest that is a planar surface located at the top of each utensil support that extends between two raised utensil slip guards which prevent utensils from moving too far laterally toward edges of the utensil supports. During use of the utensil supports, eating utensils will be placed so that they rest on the utensil rest provided by the utensil supports. The first utensil support has a centrally positioned protrusion receiver, while the second utensil support has a centrally positioned protrusion member. When the two utensil supports are reattached for storage and/or transport, the protrusion member of the second utensil support is mated with the protrusion receiver of the first utensil support in male-female fashion in order to hold the utensil supports together and prevent lateral slippage of the supports in relation to each other. Each utensil support is further provided with at least one, and preferably two, internal, permanent magnets, with the internal magnets within the first utensil support having the opposite polarity from the internal magnets located within the second utensil support. The magnetic attraction between the magnets of the two utensil supports when they are attached to each other by mating the protrusion member and the protrusion receiver together serves to further hold the utensil supports together as an assembly for storage or transport. When the utensil supports are to be used again, the utensil support assembly comprised of the attached utensil supports is disassembled by detaching the two utensil supports from one another and placing them on top of a table or counter to be used to support eating utensils during a meal. When the meal is completed, the utensil support assembly is simply reassembled by mating the two utensil supports together, and the assembly is further held together by the internal magnets for storage or transport until the next time the utensil supports are needed for use at a meal.

In one embodiment of the invention, the utensil rest of the first utensil support is marked with the letter "R" to indicate "Right," while the utensil rest of the second utensil support is marked with the letter "L" to indicate "Left." The first utensil support that has the letter "R" marked on its utensil rest also features the additional letters "K" and "S" that are separately marked on an upwardly tapered front face of the first utensil support in order to indicate that the first utensil support is the one on which a knife "K" and a spoon "S" should be placed for traditional dining etiquette purposes. The second utensil support that is marked with the letter "L" on its utensil rest features the additional letters "F" and "f" that are separately marked on an upwardly tapered front surface of the second utensil support in order to designate the second utensil support as the one on which a dinner fork "F" and a salad fork "f" should be placed for traditional dining etiquette purposes. Thus, placement of the first utensil support marked with the letter "R" on the right-hand side of a dinner plate in order to support a knife and a spoon, and placement of the second utensil support marked with the letter "L" on the left-hand side of a dinner plate in order to support a dining fork and a salad fork, will result in correct placement of the various eating utensils for traditional dining etiquette purposes.

In yet another embodiment that, is intended primarily for in-home or residential use, a utensil support storage strip is provided that can be used to stow the utensil supports when they are not in use. The utensil support storage strip has a length at least as long as three of the utensil supports and also features an adhesive strip that runs along the length of an attachment face of the utensil support storage strip and may be used to secure that storage strip to the bottom of a counter or to many other pieces of kitchen furniture or other kitchen or dining room objects or appliances. The utensil support storage strip includes at least three protrusion members that are distributed across its front face. The utensil support storage strip also includes one or more internal magnets of a certain polarity. In this embodiment, there are multiple individual utensil supports similar to those described previously, except that each of the utensil supports has a centrally located protrusion receiver that can be mated with one of the protrusion members of the utensil support storage strip when the utensil supports are be stowed on the strip while they are not in use. Each of the utensil supports further includes at least one, and preferably two, internal magnets that are of the opposite polarity from the one or more magnets that are internal to the utensil support storage strip. As can be understood, when it is desired to use the utensil supports of this embodiment, they can be detached from the utensil support storage strip and placed on the table or counter where a meal will be consumed so that eating utensils can be supported and elevated above the surface of the table or counter. When the meal is completed, the individual utensil supports can be stowed by reattaching them to the utensil support storage strip.

The above-described embodiments and other features, aspects, and advantages of the present invention may be better understood and appreciated with reference to the following drawings, descriptions, and claims. Where used in the various figures of the drawings, the same numerals designate the same or similar parts. Furthermore, when the terms "top", "bottom", "front", "back", "vertical", "horizontal", "first", "second", "third", "inside", "internal", "outside", "external", "end", "ends", "side", "sides", "edge", "edges", and similar terms are used herein, it should be understood that these terms have reference only to the structure shown in the drawings as it would appear to a person viewing the drawings and such terms are utilized only to facilitate describing the invention.

DESCRIPTION OF THE DRAWINGS

FIG. 6 shows a cross sectional view of the utensil supports that comprise the eating utensil support assembly according to the section line 6-6 of FIG. 4.

FIG. 7 shows a cross sectional view of an alternative embodiment of the utensil support assembly according to the section line 7-7 of FIG. 9.

FIG. 8 shows a front perspective view of an alternative embodiment of the utensil support assembly.

DETAILED DESCRIPTION OF THE INVENTION

Figure 1:
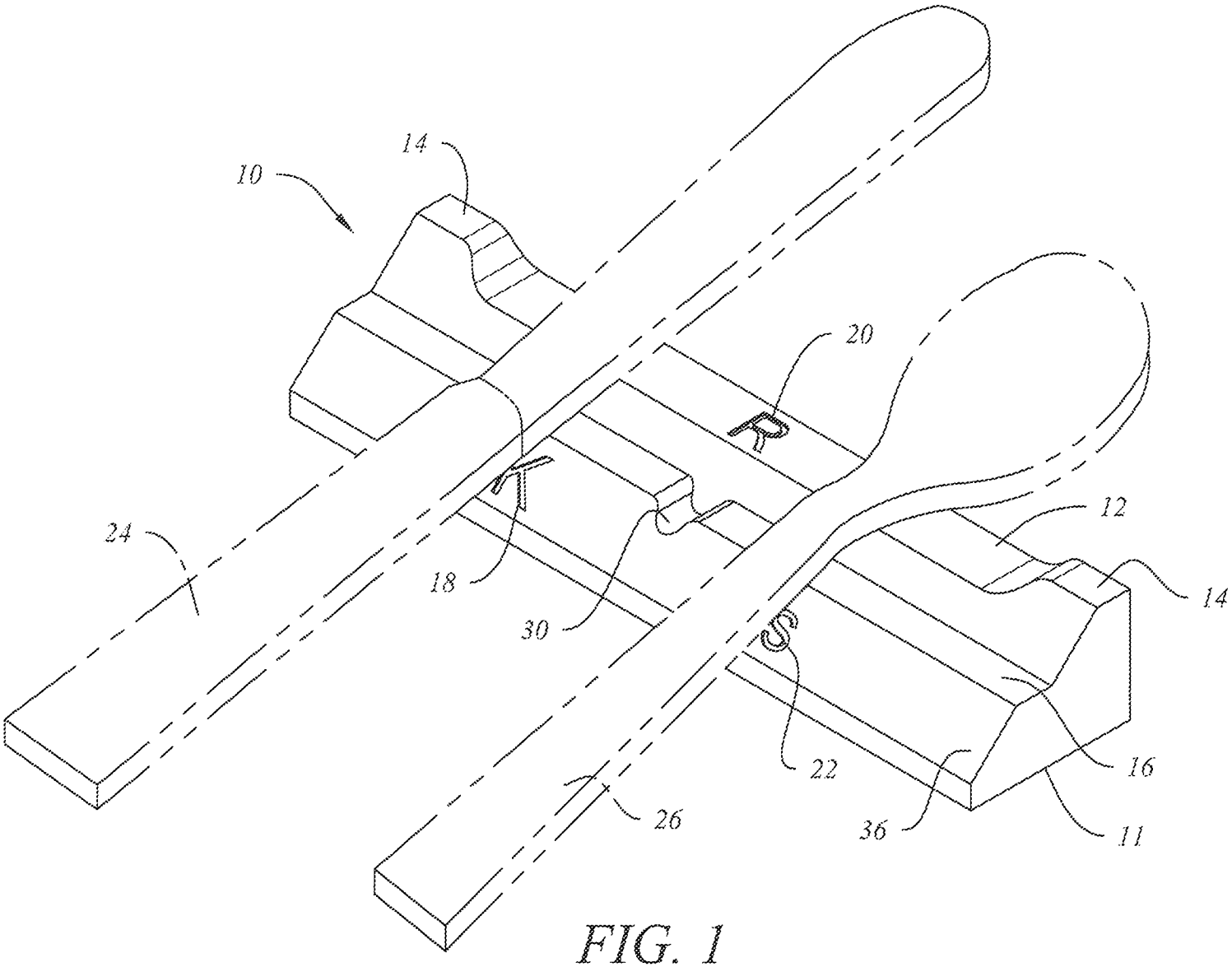
FIG. 1 shows a front perspective view of one of the utensil supports of the eating utensil support assembly as it might appear while in use supporting eating utensils.
Figure 2:
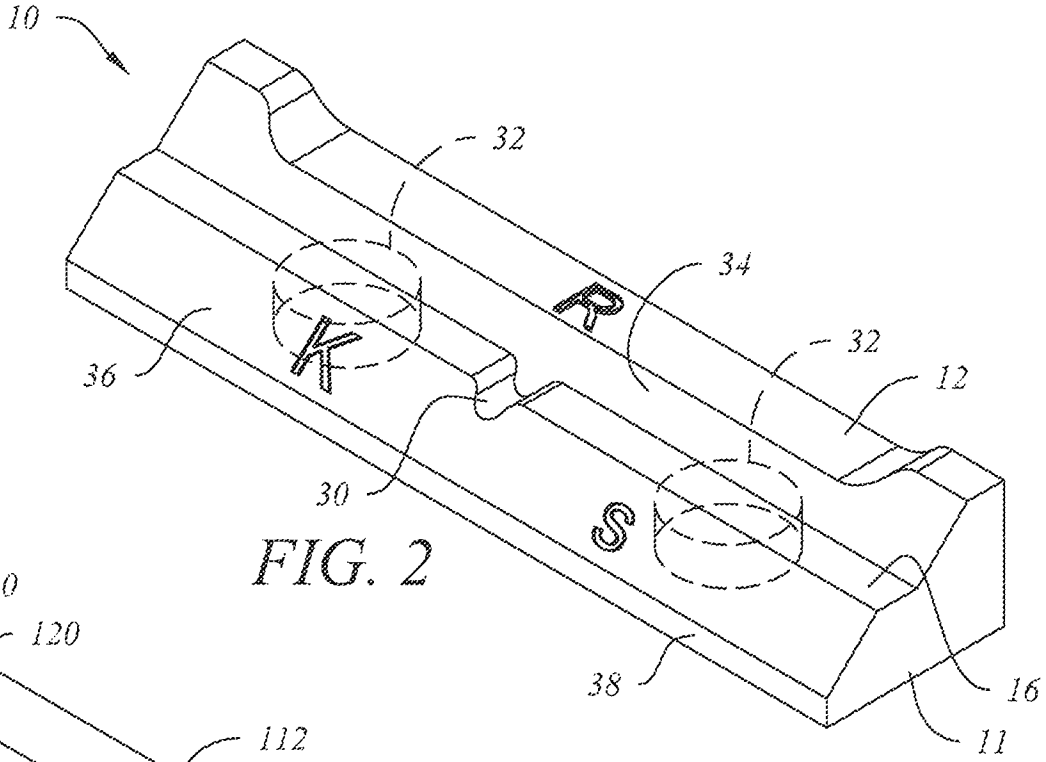
FIG. 2 shows a front perspective view of a first utensil support of the invention featuring a protrusion receiver and also shows placement of internal magnets within the first utensil support.

Referring now to the drawings, a first embodiment of the invention hereby disclosed is illustrated in FIGS. 1-6. FIG. 1-2 show a first utensil support 10 that is one half of the first embodiment of the eating utensil support assembly that is hereby disclosed. FIG. 1 shows the first utensil support 10 while it is in use supporting a knife 24 and a spoon 26 (the knife 24 and the spoon 26 are not a part of the invention). First utensil support 10 is a three dimensional body comprised of at least a utensil rest 12 that is a planar surface that will support eating utensils and that is positioned vertically above a first support base 11. In a preferred embodiment, the utensil rest 12 is located intermediate two utensil slip guards 14, each of which is located at an edge of the first utensil support 10 and rises above the utensil rest 12. The letter "R" 20 is engraved upon, molded into, or labeled on the utensil rest 12. First utensil support 10 includes a first upwardly tapered surface 34 that is immediately below the level of the utensil rest 12 and a middle planar surface 16 that is immediately below the first upwardly tapered surface 34. A second upwardly tapered surface 36 is located immediately below the middle planar surface 16. The first utensil support 10 includes a protrusion receiver 30 that is centrally disposed and extends downwardly through the middle planar surface 16 and into the second upwardly tapered surface 36. The letter "K" 18 and the letter "S" 22 are engraved, molded into, or labeled on the second upwardly tapered surface 36. FIG. 2 again illustrates the first utensil support 10 with essentially the same features as previously shown in FIG. 1, but FIG. 2 further illustrates in dashed lines that there are first internal magnets 32 that are located within the main body of the first utensil support 10, and FIG. 2 also shows a first front bottom edge 38.

Figure 3:
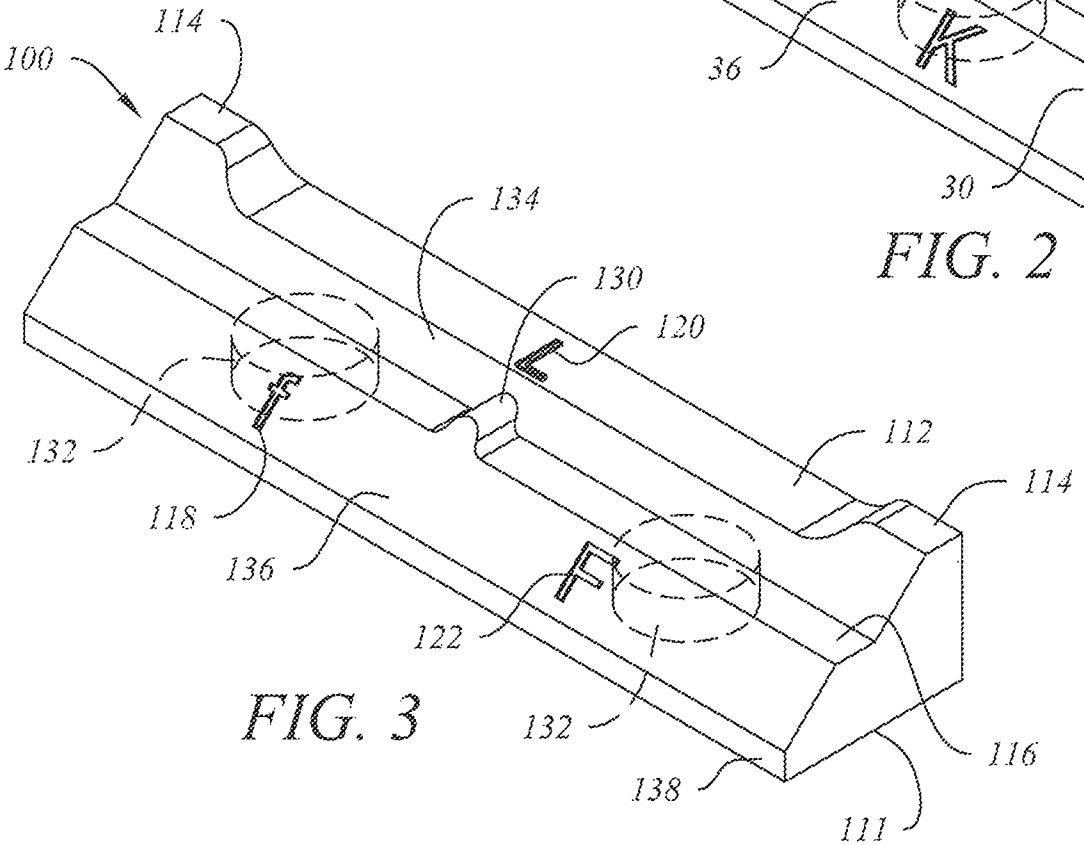
FIG. 3 shows a front perspective view of a second utensil support of the invention featuring a protrusion member and also shows placement of internal magnets within the second utensil support.

FIG. 3 illustrates a second utensil support 100 that is the second half of the first embodiment of the eating utensil support assembly that is hereby disclosed. The second utensil support 100 is a three dimensional body and shares a relatively similar structure to that which was discussed above for the first utensil support 10. The second utensil support 100 is comprised of a second utensil rest 112 that is a planar surface that will support eating utensils and is located a vertical distance above a second support base 111. The second utensil rest 112 is located intermediate second utensil slip guards 114 that are located at each edge of the second utensil support 100 and rise above the planar surface of the second utensil rest 112. The letter "L" 120 is engraved upon, molded into, or labeled on the second utensil rest 112. Second utensil support 100 includes a third upwardly tapered surface 134 that is immediately below the level of the second utensil rest 112 and a second middle planar surface 116 that is immediately below the third upwardly tapered surface 134. A fourth upwardly tapered surface 136 is located immediately below the second middle planar surface 116. The second utensil support 100 includes a protrusion member 130 that is centrally disposed and extends upwardly from the second middle planar surface 116 and above the fourth upwardly tapered surface 136. The letter "f" 118 and the letter "F" 122 are engraved, molded into, or labeled on the fourth upwardly tapered surface 136. FIG. 3 further illustrates in dashed lines that there are second internal magnets 132 that are located within the main body of the second utensil support 100, and illustrates that there is a second front bottom edge 138. The second internal magnets 132 will be of opposite polarity from the previously-described first internal magnets 32.

Figure 4:
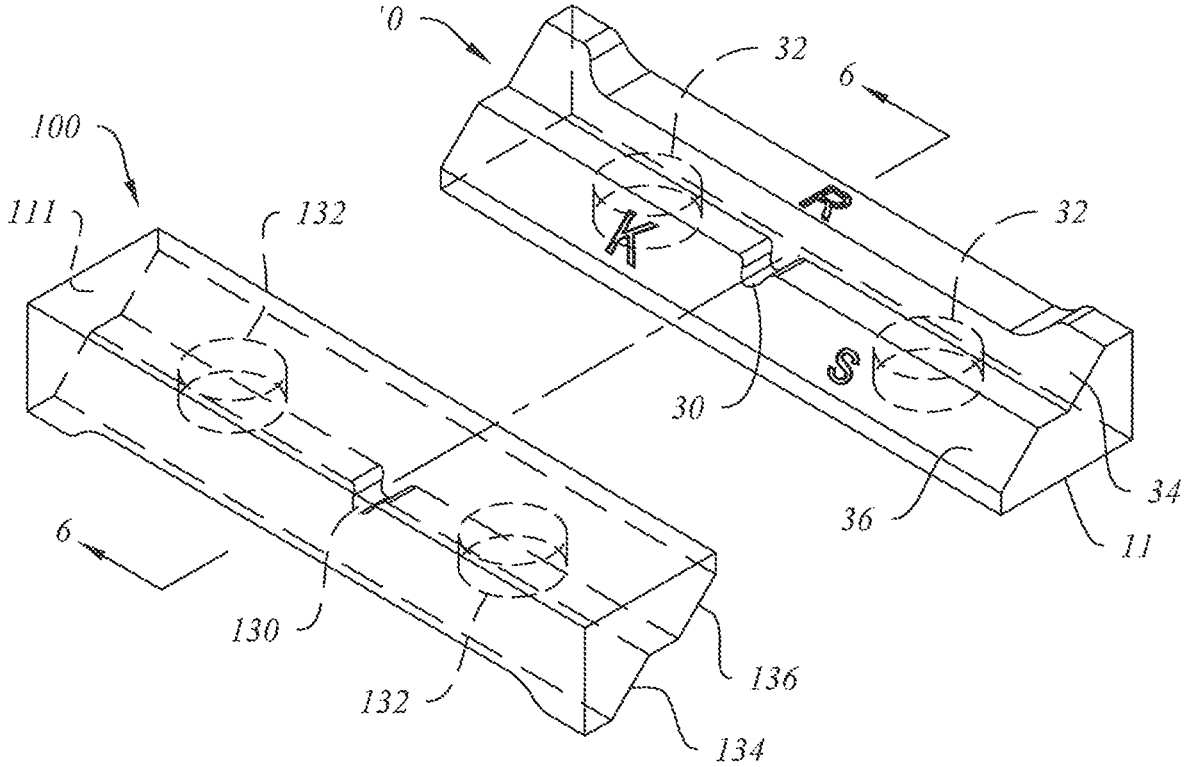
FIG. 4 shows a perspective view of the eating utensil support assembly with both utensil supports shown in the alignment they would occupy when they are initially detached from one another or at a time immediately prior to being reattached to one other.
Figure 5:
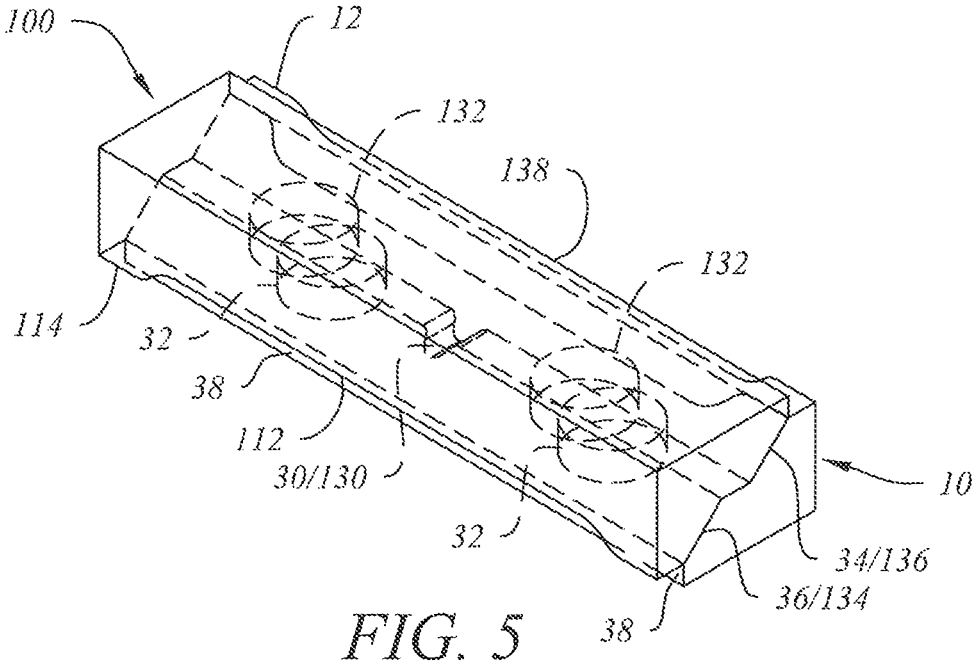
FIG. 5 shows a perspective view of the eating utensil support assembly with both of its utensil supports shown in the attached positions they would occupy when they are attached to each other for purposes of storing or transporting the eating utensil support assembly.

The first embodiment of the eating utensil support assembly hereby disclosed can be further understood with reference to FIGS. 4-5. FIG. 4 shows both utensil supports 10, 100 that, when taken jointly, comprise the first embodiment of the eating utensil support assembly. As shown in FIGS. 4-5 and as can be appreciated from descriptions provided above, the first utensil support 10 and the second utensil support 100 may be brought into mating alignment and attached together by means of the protrusion receiver 30 and the protrusion member 130, while the first internal magnets 32 and the second internal magnets 132 cooperate to hold the two utensil supports 10, 100 together and prevent lateral slippage. When it is desired to use the two utensil supports 10, 100 for supporting eating utensils above a tabletop or countertop, the first utensil support 10 may be separated from the second utensil support 100 by pulling the protrusion member out of the protrusion receiver and then they may each be placed onto a table or counter for use in supporting eating utensils. FIG. 5 illustrates how the two utensil supports 10, 100 appear at a time when they are attached to each other for storage or transport, whereas FIGS. 2-3 show how the two utensil supports 10, 100 appear when they are detached from each other and placed on a tabletop or countertop ready tor use. FIG. 6 is a cross sectional view that is taken along the 6-6 line of FIG. 4. FIG. 6 simply further illustrates how the two utensil supports 10, 100 are mated together for storage or transport when they are not in use supporting eating utensils.

As discussed, when the first embodiment of the eating utensil support assembly is to be used for supporting eating utensils or other kitchenware or silverware in order to avoid contamination by germs or foreign substances on a tabletop or countertop, the two utensil supports 10, 100 are simply detached from each other and placed on the tabletop or countertop for use. When the meal is completed, the two utensil supports 10, 100 can be reattached to each other using the protrusion receiver 30 and the protrusion member 130, along with the first internal magnets 32 and the second internal magnets 132 that help hold the two utensil supports 10, 100 together. Although both sets of internal magnets 32, 132 have been illustrated in a preferred format as a pair of two small, discrete magnets, in practice the internal magnets inside the bodies of each of the two utensil support members 10, 100 may be a single, small magnet or may be a single, layer, elongate magnet that spans almost the entire length of the utensil supports 10, 100.

FIGS. 7-10 illustrates second embodiment of the eating utensil support assembly invention that is hereby disclosed. The second embodiment is primarily intended for use in homes and private residences as opposed to restaurants or public settings. FIG. 8 shows a utensil support storage strip 200 that can be used to stow multiple utensil supports such as the three separate utensil supports 10, 300, 400 that are shown. The utensil support storage strip 200 has an adhesive strip 250 that may be used to mount the utensil support storage strip 200 to the bottom of a shelf, cabinet, counter, or other furniture, fixture, appliance or device in a kitchen or dining room. As shown in FIG. 8, utensil support storage strip 200 includes a first downwardly tapered planar surface 234, a second downwardly tapered planar surface 236, and a top vertical planar surface 248. The utensil support storage strip 200 further includes a multiplicity of protrusion members 227, 229, 230 that depend downwardly from the second downwardly tapered planar surface 236, along with multiple pairs of storage strip internal magnets 231, 232, 233. As shown, utensil support 10 features a centrally-located protrusion receiver 30 and first internal magnets 32 that should be of opposite polarity from the storage strip internal magnets 231, 232, 233 that are internal to the utensil support storage strip 200. These features of utensil support 10 allow it to be stowed on the utensil support storage strip 200 when utensil support 10 is not in use. In practice, each of the utensil supports 10, 300, 400 that may be stowed on the utensil support storage strip 200 will have a centrally located protrusion receiver and at least one, and preferably a pair of, internal magnets of opposite polarity from the storage strip internal magnets 231, 232, 233. In that way, when the utensil supports 10, 300, 400 are not in use, they may be stowed on the utensil support storage strip 200 by attaching the utensil supports 10, 300, 400 to the utensil support storage strip 200 by means of the male-female connection of the protrusion receivers on the utensil supports 10, 300, 400 and the multiplicity of protrusion members 227, 229, 230 provided on the utensil support storage strip 200. This attachment for stowage purposes also takes advantage of the magnetic attraction between the internal magnets of the utensil supports 10, 300, 400 and the storage strip internal magnets 231, 232, 233. When it is desired to use the utensil supports 10, 300, 400 to support eating utensils on tables or counters, the supports 10, 300, 400 are simply detached from the utensil support storage strip 200 and placed on the surface of the table or counter for use in a manner that is similar or the same as what was illustrated in FIG. 1.

Figure 9:
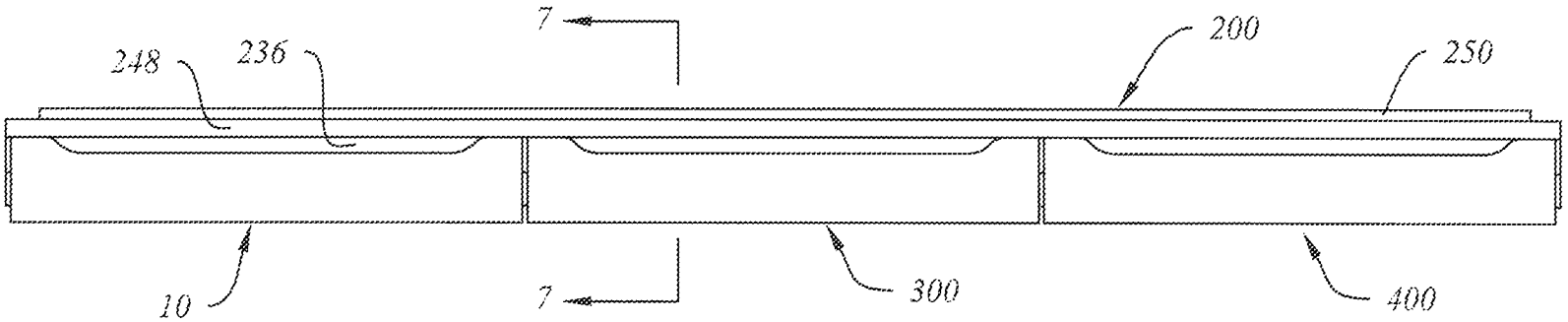
FIG. 9 shows a front view of an alternative embodiment of the utensil support assembly.

FIG. 9 shows the utensil support storage strip 200 with the utensil supports 10, 300, 400 in stowed position on the utensil support storage strip 200. FIG. 7 shows a cross sectional view of the utensil support storage strip 200 with the utensil supports 10, 300, 400 in stowed position on the utensil support storage strip 200. FIG. 7 also shows a first horizontal planar surface 212 of the utensil support storage strip 200 and a second horizontal planar surface 230 of the storage strip 200. In addition, FIG. 7 shows a utensil slip guard 314, a utensil rest 312, and an internal magnet 332, all of which are included in the utensil support 300 that is visualized and are essentially the same in design as previously discussed for utensil support 10. FIG. 7 is intended to further demonstrate how utensil support 300 can be attached to the utensil support storage strip 200 when the utensil support 300 is not in rise and is stowed. As explained previously, the utensil supports, 10, 300, 400 will be attached to the storage strip 200 when not in use and will be detached from the utensil support storage strip 200 when it is desired to use the utensil supports 10, 300, 400 for their primary purpose of supporting eating utensils above the surfaces of tables or counters.

Figure 10:
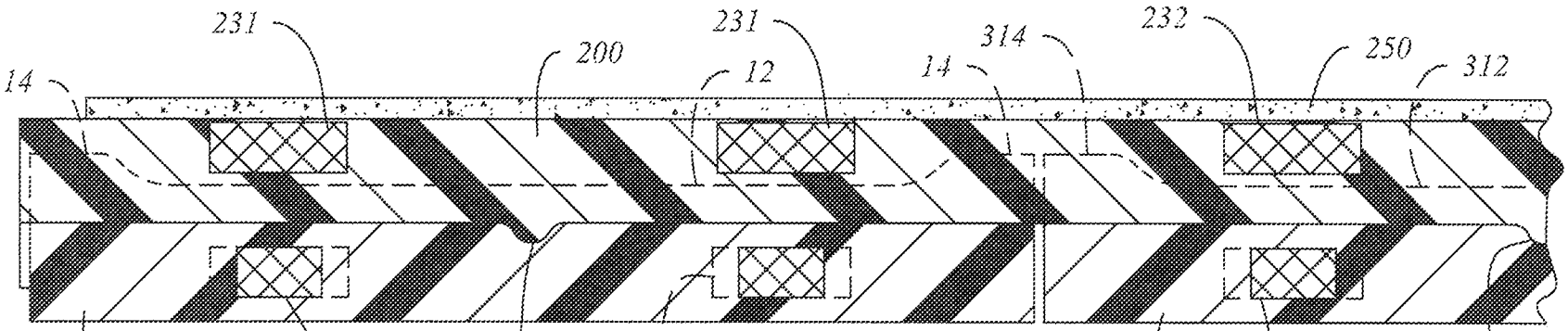
FIG. 10 shows a partial cross sectional view of an alternative embodiment of the utensil support assembly according to the section line 10-10 of FIG. 7.

FIG. 10 is a partial cross sectional view of the utensil support storage strip 200 taken along the 10-10 line of FIG. 7. FIG. 10 illustrates the appearance of the alternative embodiment of the invention with utensil supports 10, 300 (partial) shown in a stowed position attached to the storage strip 200. FIG. 10 again shows the adhesive strip 250 that can be used to affix the storage strip 200 to the bottom of a counter, cabinet, or other kitchen or dining room fixture or appliance.

Figure 11:
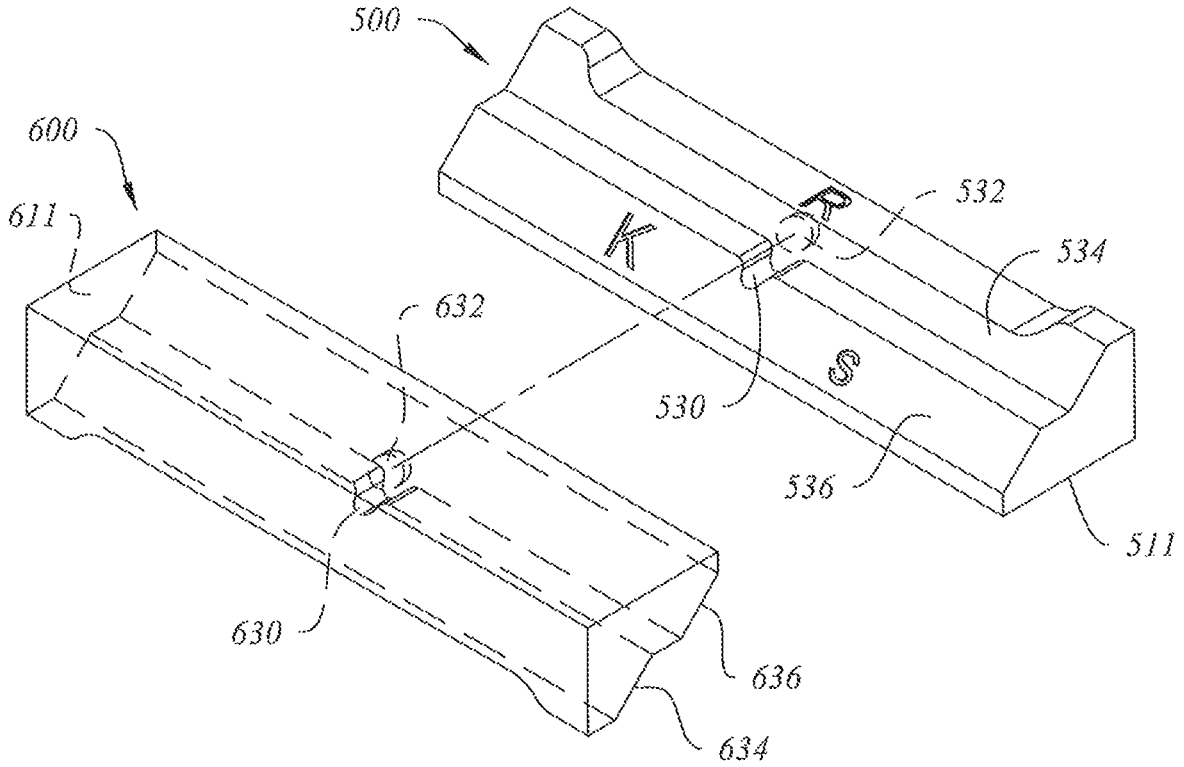
FIG. 11 shows another embodiment of the invention in which the utensil supports comprising the utensil support assembly are detached from one another, and each utensil support is illustrated with a single internal magnet.
Figure 12:
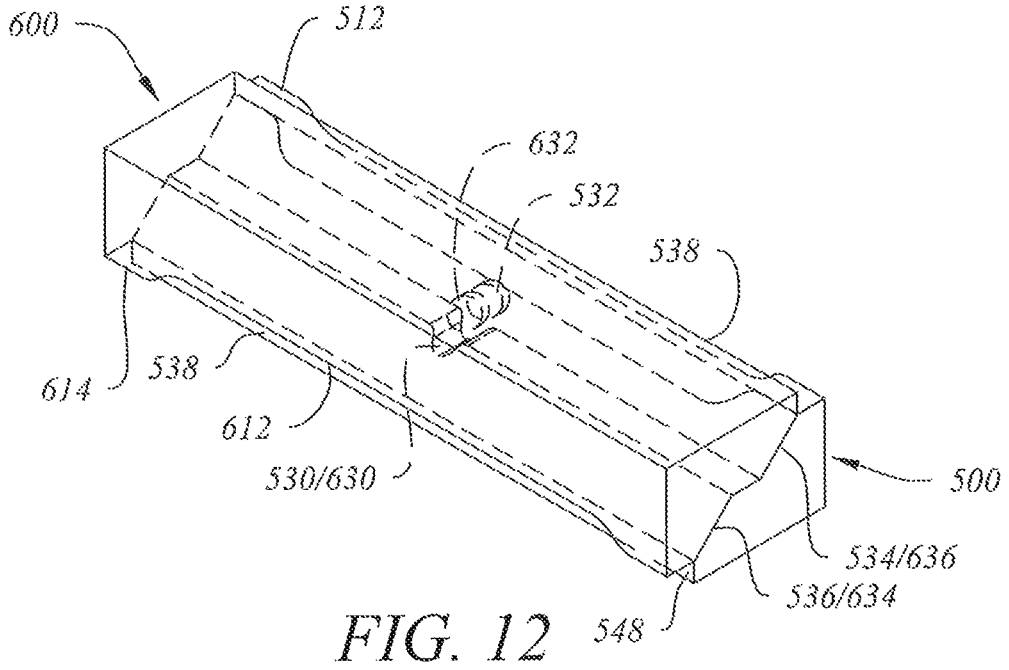
FIG. 12 shows another embodiment of the invention in which the utensil supports comprising the utensil support assembly are attached from one another, and each utensil support is again illustrated with a single internal magnet.

FIGS. 11-12 show a variation on the first embodiment of the invention. FIGS. 11-12 illustrate a variation on the disclosed assembly comprised of a first alternate utensil support 500 and a second alternate utensil support 600. The alternate utensil supports 500, 600 have many of the same features as previously described, such as respective support bases 511, 611, respective multiple upwardly tapered surfaces 534, 536, 634, 636. The first alternate utensil support 500 is illustrated as having centrally-positioned protrusion receiver 530 and a first single magnet 532 that is internal to, and centrally located within, the body of the first alternate utensil support 500. Likewise, the second alternate utensil support 600 is illustrated as having a centrally-positioned protrusion member 630 and a second single magnet 632 that is internal to, and centrally located within, the body of the second alternate utensil support 600. Taken together, FIGS. 11-12 illustrate the variation or the first embodiment, of the invention in detached position (FIG. 11) and in attached/stowed position (FIG. 12). The variation of the first embodiment illustrated in FIGS. 11-12 is merely meant to convey that there are alternative embodiments on the invention in which a single magnet may be used within each of the two utensil supports, but as set forth previously, it is preferred to have at least a pair of internal magnets internal to each of the utensil supports.

The utensil supports 10, 100 that comprise the first embodiment of the eating utensil support assembly, and the single-magnet variants of the utensil supports 500, 600, are all preferably made of a substantially rigid material such as a rigid plastic, but may be made of any suitable material that is substantially rigid, including metal or wood. Likewise, the utensil support storage strip 200 and the three utensil supports 10, 300, 400 that comprise the second embodiment of the invention hereby disclosed will be made of a substantially rigid material such as a rigid plastic, wood, or metal.

It can therefore be seen that both embodiments of the eating utensil support assembly hereby disclosed will serve as an elegant and efficient way to support eating utensils above surfaces that may not be clean or sanitized, such as tabletops and countertops in restaurants, homes, or other residences. The embodiments show that the eating utensil support assembly provides a unique and useful way to store and/or transport utensil supports when they are not in use, and also provides assistance with regard to proper placement of eating utensils for dining etiquette purposes. Thus, the instant invention represents a significant advancement in the art which has substantial merit.

Although the inventive concepts hereby disclosed have been described with reference to two specific embodiments, it should be understood that the above-described specific embodiments are not intended to limit the scope of the inventive concepts disclosed, but merely to illustrate some of the specific embodiments of the eating utensil support assembly. It should be understood that various modifications of the disclosed embodiments, as well as alternative embodiments of the inventive concepts, will be apparent to persons skilled in the art upon reference to the description of the embodiments that is provided or upon reference to the appended claims. It is, therefore contemplated that the appended claims cover and read upon all such modifications and alternative embodiments that fall within the scope of the inventive concepts that are claimed by the inventors. Furthermore, although the instant invention has generally been described and shown in the drawings as being used to support utensils such as forks, knives, and spoons, other eating utensils such as chopsticks may also be supported by the utensil supports of the assembly.

Lastly, in the first embodiment of the eating utensil support assembly hereby disclosed, detachable connection of the two utensil supports 10, 100 may be accomplished by use of a standard hook a d ii op type fastening system, such as VELCRO®. Such hook and loop fastening systems are well known and understood, and can be used on any one or more surfaces of the two utensil supports 10, 100 in order to detachably connect and hold the supports together for storage or transport when the eating utensil support assembly is not in use.

Having thus described the aforementioned embodiments of the invention, What we claim is:

1. An eating utensil support assembly comprising:

a first utensil support having a three dimensional body with at least a support base and a utensil rest that is an elevated planar surface located above the support base on which eating utensils may be supported;

a second utensil support having a three dimensional body with at least a support base and a utensil rest that is an elevated planar surface located above the support base on which eating utensils may be supported;

wherein the first utensil support and the second utensil support are each further comprised of a magnet such that the magnets of the first utensil support and second utensil support can cooperate to serve as detachable attachment means that allow for the first utensil support and the second utensil support to be detachably connected to each other for storage or transport when the eating utensil support assembly is not being used to support eating utensils, and such that the first utensil support can be detached from the second utensil support since such detachment and separate use of the two utensil supports is necessary to properly use the eating utensil support assembly for supporting eating utensils above a surface such as a table or countertop.

2. The assembly of claim 1 wherein the first utensil support further comprises a total of two utensil slip guards that both rise above the planar surface of the utensil rest, with the utensil rest of the first utensil support being located intermediate of the two utensil slip guards such that the two slip guards serve as an impediment to utensils slipping off the edges at the two sides of the first utensil support when it is in use supporting eating utensils above a surface; and wherein the second utensil support also further comprises a total of two utensil slip guards that both rise above the planar surface of the utensil rest of the second utensil support and wherein the utensil rest is located intermediate of the two utensil slip guards such that the two slip guards serve as an impediment to utensils slipping off the edges at the two sides of the second utensil support when it is in use supporting eating utensils above a surface.

3. The assembly of claim 2 wherein the first utensil support and the second utensil support are provided with alignment means comprised of a protrusion member and a protrusion receiver that prevent lateral sliding of the first utensil support and the second utensil support in relation to one another when they are detachably connected to each other for storage or transport when the eating utensil support assembly is not being used to support eating utensils.

4. The assembly of claim 3 wherein the magnet of the first utensil support is a magnet of a certain polarity and the magnet of the second utensil support is a magnet with a polarity that is opposite from the magnet of the first utensil support.

5. The assembly of claim 3 wherein the protrusion receiver is located on the first utensil support and the protrusion member is located on the second utensil support.

6. The assembly of claim 1 wherein the utensil rest of the first utensil support is marked with the letter "R" and the utensil rest of the second utensil support is marked with the letter "L".

7. The assembly of claim 6 wherein the first utensil support is marked with the letters "K" and "S", and wherein the second utensil support is marked with the letters "f" and "F".

8. The assembly of claim 1 wherein the detachable attachment means are a multiplicity of magnets of a certain polarity that are connected to the body of the first utensil support and a multiplicity of magnets of the opposite polarity that are connected to the body of the second utensil support.

9. The assembly of claim 8 wherein the multiplicity of magnets of a certain polarity that are connected to the first utensil support are located inside the body of the first utensil support, and wherein the multiplicity of magnets of the opposite polarity that are connected to the second utensil support are located inside the body of the second utensil support.

10. The assembly of claim 1 wherein the magnet of the first utensil support is internal to the body of the first utensil support, and wherein the magnet of the second utensil support is internal to the body of the second utensil support.

11. The eating utensil support assembly of claim 1 wherein the first utensil support and the second utensil support each further comprise multiple planar surfaces that are brought into abutment when the first utensil support and the second utensil support are detachably connected.

12. An eating utensil support assembly comprising a first utensil support having a three dimensional body with at least a support base and a utensil rest that is an elevated planar surface located above the support base on which eating utensils may be supported;

a second utensil support having a three dimensional body with at least a support base and a utensil rest that is an elevated planar surface located above the support base on which eating utensils may be supported;

attachment means for detachably attaching the first utensil support and the second utensil support comprised of a hook and loop type fastening system.

13. An eating utensil support assembly comprising:

a first utensil support having a three dimensional body comprising:

a support base;

a utensil rest that is an elevated planar surface located above the support base on which eating utensils may be supported and wherein the utensil rest is marked with the letter "R";

two utensil slip guards that rise above the planar surface of the utensil rest, with the utensil rest of the first utensil support being located intermediate of the two utensil slip guards;

an upwardly tapered surface located intermediate the support base and the utensil rest wherein the upwardly tapered surface is marked with the letters "K" and "S";

a protrusion receiver located on the first utensil support;

a first magnet of a certain polarity that is internal to the body of the first utensil support;

a second utensil support having a three dimensional body comprising:

a support base;

a utensil rest that is an elevated planar surface located above the support base on which eating utensils may be supported and wherein the utensil rest is marked with the letter "L";

two utensil slip guards that rise above the planer surface of the utensil rest, with the utensil rest of the second utensil support being located intermediate of the two utensil slip guards;

an upwardly tapered surface located intermediate the support base and the utensil rest wherein the upwardly tapered surface is marked with the letters "f" and "F";

a protrusion member located of the second utensil support;

a second magnet that is internal to the body of the second utensil support therein the polarity of the second magnet is the opposite of the first magnet of the first utensil support.

14. The assembly of claim 13 wherein the assembly is entirely made of a rigid plastic, with the only exceptions being the first magnet and the second magnet, which are made of a magnetic material.

15. An eating utensil support assembly system comprising:

a utensil support storage strip having an elongate three dimensional body comprising:

an elongate mounting base for mounting the utensil support storage strip on some other surface such as the underside of a shelf, counter, or table;

an adhesion strip along the length of the mounting base that may be used to connect the utensil support storage strip to some other surface, such as the underside of a shelf, table, or counter;

one or more storage strip magnets that are of a certain polarity;

a multiplicity of utensil supports, each utensil support comprising:

a support base;

a utensil rest that is an elevated planar surface located above the support base on which eating utensils may be supported;

at least one utensil support magnet having a polarity that is the opposite of the polarity of the one or more storage strip magnets.

16. The eating utensil support assembly system of claim 15 further comprising:

a multiplicity of protrusion members positioned along the length of the elongate body of the utensil support storage strip;

a protrusion receiver located on the body of each of the multiple utensil supports.

17. The system of claim 16 wherein the utensil support storage strip further comprises a first downwardly tapered planar surface, a second downwardly tapered planar surface, and a top vertical planar surface.

18. The system of claim 17 wherein the utensil support storage strip further comprises a first horizontal planar surface and a second horizontal planar surface.

19. The assembly system of claim 16 wherein the assembly is entirely made of a rigid plastic, with the only exceptions being the one or more storage strip magnets and the utensil support magnets, which are made of a magnetic material.

20. The eating utensil support assembly system of claim 15 further comprising:

a multiplicity of protrusion receivers positioned along the length of the elongate body of the utensil support storage strip;

a protrusion member located on the body of each of the multiple utensil supports.

21. The system of claim 15 wherein the one or more storage strip magnets that are of a certain polarity are located internal to the body of the utensil support storage strip, and wherein each of the utensil support magnets is located internal to a utensil support.

* * * * *